US007193155B2

(12) United States Patent
McMillan et al.

(10) Patent No.: US 7,193,155 B2
(45) Date of Patent: Mar. 20, 2007

(54) COMMUNICATION CABLES INCLUDING COLORED CONDUCTORS OR FIBERS AND METHODS FOR MAKING AND USING THE SAME

(75) Inventors: T. Mike McMillan, Marietta, GA (US); Scott Dillon, Great Bend, KS (US)

(73) Assignee: Superior Essex Communications LP, Atlanta, GA (US)

( * ) Notice: Subject to any disclaimer, the term of this patent is extended or adjusted under 35 U.S.C. 154(b) by 418 days.

(21) Appl. No.: 10/697,969

(22) Filed: Oct. 29, 2003

(65) Prior Publication Data

US 2005/0252676 A1 Nov. 17, 2005

(51) Int. Cl.
*H01B 7/36* (2006.01)

(52) U.S. Cl. ..... 174/112; 385/109

(58) Field of Classification Search ..... 174/112; 385/109

See application file for complete search history.

(56) References Cited

U.S. PATENT DOCUMENTS

| | | | | |
|---|---|---|---|---|
| 1,667,824 | A | 5/1928 | Richey | |
| 1,798,486 | A * | 3/1931 | Murphy | 174/112 |
| 2,702,056 | A * | 2/1955 | Hoeselbarth | 139/403 |
| 3,020,335 | A | 2/1962 | Gillis | |
| 3,031,524 | A | 4/1962 | Hicks | |
| 3,102,160 | A | 8/1963 | Cook et al. | |
| 3,720,747 | A | 3/1973 | Anderson et al. | |
| 4,128,736 | A | 12/1978 | Nutt et al. | |
| 4,158,746 | A | 6/1979 | Taylor et al. | |
| 4,341,014 | A | 7/1982 | Loy et al. | |
| 4,528,420 | A | 7/1985 | Kish et al. | |
| 4,629,285 | A | 12/1986 | Carter et al. | |
| 4,716,073 | A | 12/1987 | Randa | |
| 4,761,129 | A | 8/1988 | Aste et al. | |
| 4,877,645 | A | 10/1989 | Bleich et al. | |
| 4,971,567 | A * | 11/1990 | Mizuno et al. | 439/98 |
| 5,187,329 | A | 2/1993 | Bleich et al. | |
| 5,281,764 | A | 1/1994 | King et al. | |
| 5,401,908 | A | 3/1995 | Rodeghero | |
| 5,775,935 | A * | 7/1998 | Barna | 439/488 |
| 6,194,652 | B1 * | 2/2001 | Ivan | 174/33 |
| 6,211,117 | B1 | 4/2001 | Haggerty et al. | |
| 6,293,081 | B1 | 9/2001 | Grulick et al. | |
| 6,392,152 | B1 | 5/2002 | Mottine, Jr. et al. | |
| 6,429,237 | B1 | 8/2002 | Tooley | |
| 6,479,607 | B1 | 11/2002 | Milan et al. | |
| 6,532,329 | B1 | 3/2003 | Thompson | |
| 2004/0022504 | A1 * | 2/2004 | Hurley et al. | 385/109 |

* cited by examiner

*Primary Examiner*—Chau N. Nguyen
(74) *Attorney, Agent, or Firm*—Michael L. Wach; King & Spalding

(57) ABSTRACT

A communications apparatus for transmitting various communication signals is described. The communications apparatus contains at least two conductors or fibers where the first conductor or fiber comprises a first color and the second conductor or fiber comprises a second color having a lighter tint of the first color. In an embodiment of the invention, using this scheme of a dark shade of a color for one of the conductors or fibers and a lighter color for the other conductor or fiber, the conductors or fibers can always be identified as a pair even after they have been untwisted (and even when the remaining pairs in the cable become untwisted). The invention does not use bandmarks or stripes in the insulation of the second conductor, thereby avoiding the accompanying limitations associated with bandmarks and stripes.

21 Claims, 3 Drawing Sheets

COMMUNICATION CABLES INCLUDING COLORED CONDUCTORS OR FIBERS AND METHODS FOR MAKING AND USING THE SAME

FIELD OF THE INVENTION

This invention generally relates to voice, video and data communication cables. More particularly, the invention relates to communication cables containing colored conductors or fibers.

BACKGROUND OF THE INVENTION

Communication cables are generally used to transmit a variety of signals, including voice, video, and data signals. Each cable typically contains a single or multiple strands of a transmission media (e.g., conductor often made of copper or a fiber often made of glass). In one cable design, the strands of insulated transmission media are contained within a hollow core of a tubular jacket. The insulating material, often called the insulation, confines the signals to the transmission media during transmission. While the jacket can be electrically insulating, its main purpose is to provide mechanical and environmental protection.

In addition to exhibiting many other characteristics, it is often necessary that communication cables exhibit fire resistance. When installed in buildings, communication cables are often routed through the ductwork of the building's air exchange system. Such cables are called plenum cables. One type of plenum cable often used in voice and data communication systems of commercial buildings is an UTP (unshielded twisted pair) cable. Generally, UTP types of cable contain four individually twisted wire pairs comprised of 24 AWG copper conductors. Each wire is individually insulated with an insulation material.

The insulation for the conductors in each twisted pair is typically made of one solid color for a first conductor and the second conductor contains a white color that is bandmarked or striped with the same color as the first color. Using this scheme, the conductors can always be identified as a pair even after they have been untwisted (and even when the remaining pairs in the cable become untwisted). These coloring schemes, and other identification schemes, are described in U.S. Pat. Nos. 6,293,081, 6,211,117, 6,532,329, and 6,479,607, the disclosures of which are incorporated herein by reference.

Unfortunately, none of these conventional coloring schemes for identification is completely satisfactory. Bandmarking can require the use of hazardous solvents such as methyl ethyl ketone, alcohol or cyclohexane. As well, bandmarks can cause imperfections in the insulation material and can also interfere with the product line diameter and control system, thereby causing the bandmarked conductors to be smaller than the non-bandmarked conductors. Further, both bandmarking and striping processes require additional production equipment, a bandmarking machine and a tandem extruder respectively. Finally, both stripes and bandmarks can cause a discontinuity in the insulation that can degrade the transmission integrity.

SUMMARY OF THE INVENTION

A communications apparatus for transmitting various communication signals is described. The communications apparatus contains at least two conductors or fibers where the first conductor or fiber comprises a first color and the second conductor or fiber comprises a second color having a lighter tint of the first color. In an embodiment of the invention, using this scheme of a dark shade of a color for one of the conductors or fibers and a lighter color for the other conductor or fiber, the conductors or fibers can always be identified as a pair even after they have been untwisted (and even when the remaining pairs in the cable become untwisted). The invention does not use bandmarks or stripes in the insulation of the second conductor, thereby avoiding the accompanying limitations associated with bandmarks and stripes.

BRIEF DESCRIPTION OF THE DRAWINGS

FIGS. 1–4 are views of several aspects of the communication cables and methods for making and using the same according to the invention, in which:

FIG. 1 shows a side view of a plenum cable in one aspect of the invention;

FIG. 2 shows a view of a twisted pair in one aspect of the invention;

FIG. 3 depicts a perspective view of a plenum cable in one aspect of the invention;

FIG. 4 illustrates a view of a group of cables enclosed within a jacket in one aspect of the invention.

FIGS. 1–4 illustrate specific aspects of the invention and are a part of the specification. Together with the following description, the Figures demonstrate and explain the principles of the invention and are views of only particular—rather than complete—portions of the invention.

DETAILED DESCRIPTION OF THE INVENTION

The following description provides specific details in order to provide a thorough understanding of the invention. The skilled artisan, however, would understand that the invention can be practiced without employing these specific details. Indeed, the present invention can be practiced by modifying the illustrated cables and methods and can be used in conjunction with apparatus and techniques conventionally used in the industry. For example, the invention is described below for plenum cables, but could be used in non-plenum cables, wires, unjacketed pairs of conductors or fibers, or even in cables with different transmission requirements.

In an embodiment of the invention, a plurality of twisted pairs of insulated conductors are provided, wherein the insulation has a unique coloring scheme. The coloring scheme uses a solid dark color for the insulation of a first conductor and a lighter tint or shade of the same color in the insulation for the second conductor. In one implementation of the invention, the invention is used in a plenum cable illustrated in FIG. 1. Of course, the invention could be used in various other plenum cables, so long as the plenum cable uses an insulation material for a pair of conductors whether they are twisted or not. Moreover, as will be described below, the coloring scheme described herein can be used with non-plenum cables, wires, unjacketed pairs, fiber optic cables and other communication apparatus containing two or more differentiated members.

Figure 1:
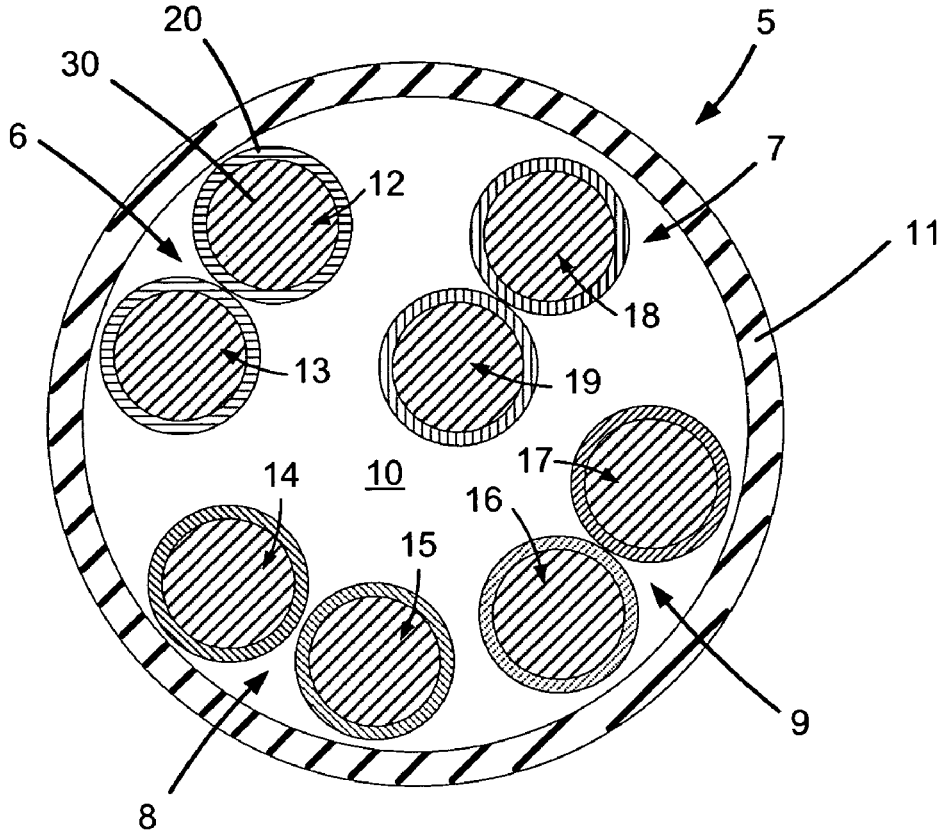

In the embodiment illustrated in FIG. 1, a cable 5 contains a core 10 contained within a jacket 11. The cable 5 is substantially rectangular, cylindrical, or tubular in shape. In one aspect of the invention, the shape of cable 5 is substantially cylindrical. The core 10 is generally hollow, but can be optionally filled with separators, binders, ripcords and/or tapes if desired.

Core 10 contains plurality of insulated conductors 12, 13, 14, 15, 16, 17, 18, and 19. Each insulated conductor contains a conductor 30 surrounded by an insulator 20. Each insulated conductor is twisted with another insulated conductor to form a twisted pair (respectively, 6, 7, 8, and 9, see also FIG. 3) of insulated conductors. The twisted pairs are then bunched together to form a bundle of twisted pairs contained within the jacket 11.

The term "conductor" as used herein refers to the current-carrying component of the cable 5. Typically, the conductor 30 comprises a single or multi-strand metal filament that is coated with the insulating material. The conductor 30 can be made of any electrically conducting material such as metal and metal alloys, but is typically made of copper or a copper alloy.

The insulator 20 confines the electrical signals to the conductor 30 during signal transmission. Thus, the insulator 20 can be fabricated from a wide variety of materials serving this function, including uncurable, thermoset, and thermoplastic polymers. Examples of suitable thermoplastic polymers include polyvinyl chloride (PVC), and various polyolefins, such as polyethylene, polypropylene, and/or combinations of these materials. If necessary, and especially for the outermost layer of the insulation, the thermoplastic polymer can contain compatible first retardant polymers or fire retardant additives (such as fillers) that minimize smoke generation and flame spread, such as phosphonate compounds.

In the invention, a twisted pair of conductors in the cable 5 contains a coloring scheme with a substantially solid dark color in the insulation of the first conductor and with no bandmarks or stripes in the insulation of the second conductor. The coloring scheme instead uses a lighter tint or shade of the color used for the first conductor in the insulation for the second conductor. Thus, in the aspect of the invention depicted in FIG. 2 which shows a twisted pair of conductors 25 and 35, the insulation 26 for the first conductor 25 would contain a solid color, for example, dark blue. The insulation 36 for the second conductor 35 would then contain a tint or shade of the same color (i.e., light blue) without any bandmarks or stripes.

The amount of color that is used in the tint or shade in the insulation of the second conductor depends primarily on the amount of color that is used in the insulation for the first conductor. As well, the amount of color depends on other factors like the type of insulation material and the concentration of color, as well as the processing used to make the tint or shade (described below).

For example, if green is selected as the color to identify the twisted pair, the "degree" or amount of green could be classified by an integer from 0 to 9, where 0 to 2 vary from water-clear to opaque white, 3 to 5 range from pale green to a medium green color, and 6 to 9 range from a medium green to an intense green color. In this example, the color for the first conductor could be selected ranging from 9 down to 1 and the color for the second conductor could respectively range from 8 down to 0. In fact, the color used in the first conductor and the tint/shade of the same color in the second conductor need only be different enough so that a user of the cable (such as an installer) could differentiate between them, while at the same time understand that both contain different shades of the same color and therefore are a twisted pair of conductors.

In another aspect of the invention, the classification of tints/shades of colors used in the first and second conductors can be based on the classification system set forth in Bellcore GR-20-CORE, section 6.2.5, titled "Fiber Unit and Identification," the contents of which are incorporated herein by reference in their entirety. In another aspect of the invention the classification of the tints/shades of color can be based on the TIA/EIA-598-A Standard, titled "Optical Fiber Cable Color Coding," which is incorporated herein by reference in its entirety. Alternatively, the tints/shades of colors may also be classified or distinguished according to the TIA/EIA-568-A standards set forth in October, 1995, which standards are incorporated herein by reference in their entirety. Those skilled in the art will understand that other systems for color classification may also be used in the present invention.

In one aspect of the invention, the entire length of the insulation of the first and second conductor is made using the selected color. This aspect of the invention might be implemented for ease of manufacture. In another aspect of the invention, however, only selected portions of the insulation (such as where the user will access the cable) will contain insulations with these colors. This aspect of the invention might be implemented for low cost manufacturing.

In one aspect of the invention, the tinted color for the second conductor can be incorporated directly into the insulation for the second conductor (as described below). If there is a plurality of layers, the tinted color can be incorporated into the outermost layer, or into an inner layer provided that the outer layer(s) covering it are substantially transparent.

In another aspect of the invention, the tinted color for the second conductor can be incorporated into a layer separate from the insulation. Here, the tinted color could be incorporated into an outer layer that is placed over the insulation. As well, the tinted color could be incorporated into a separate inner layer provided the insulation layer(s) covering it are substantially transparent.

In the aspects of the invention described above, the twisted pair with solid color and tinted color insulation can be used in combination with other insulated pairs in a cable. In other words, a single twisted pair is formed using the insulation containing the color scheme described above (e.g., blue). Then, the single twisted pair could be combined with other conventional twisted pairs (i.e., without the coloring scheme of the invention) to make the plenum cable. In another aspect of the invention, any number of the remaining twisted pairs could also contain a color scheme, but with a different color (e.g., red, green, purple, etc. . . . ).

In the invention, the communication cable 5 can also contain a binder and/or a ripcord. The binder serves to contain or confine the transmission medium along part or all of the length of the communication cable. Several types of binders are known in the art (helical, longitudinal, or counter-helical wound) and can be used in the communication cables of the invention.

The communication cable of the invention may also contain a ripcord. The ripcord serves to provide access to the core of the communication cable by separating the jacket 11. For example, one can grasp an end of the ripcord and pull it outward away from an outer surface of the jacket 11, thereby splitting the jacket 11 and exposing the core 10. Any configuration for the ripcord that achieves this function can be employed in the invention.

The jacket 11 is also electrically insulating, even though its main purpose is to provide mechanical and environmental protection. Thus, the cable jacket 11 can be fabricated from a wide variety of materials serving this function, including uncurable, thermoset, and thermoplastic polymers. Examples of thermoplastics polymers include those listed above, as well as those known in the art. In one aspect of the invention, a low-smoke PVC material is used in the jacket. In another aspect of the invention, such as where the cable is used in a Riser application or cables with pair counts greater than 4, the jacket can be made with different PVC materials, PVDF, PVDF/PVC polymers, ETCFE, and other fluoropolymers. These materials can be solid or foamed. The thickness of the jacket can be any thickness commonly used in plenum cables for the materials listed above.

The plenum cables containing such a coloring scheme can be made with any known process that will provide the color scheme as described above. In one aspect of the invention, the plenum cables are manufactured by obtaining a first conductor and a second conductor. Then the insulation material is provided on the first and second conductors by any number of techniques, such as a polymer extrusion process using a polymeric resin mixture.

Before providing the insulation material on the conductor, the appropriate color for the first conductor and the second conductor, respectively, is determined. The insulation material (first resin mixture) for the first conductor is then provided with its appropriate color and the insulation material (second resin mixture) is then provided with its appropriate color. This color can be provided in any number of ways, including adding the appropriate amount of a pigment or a dye (or other color additive) to the resin mixture. Then, an extrusion process is used to provide the first colored resin mixture on the first conductor. An extrusion process is also used to provide the second colored resin mixture on the second conductor.

If necessary, additional twisted pairs of the plenum cable (but with different colors where desired) can be provided using a similar method. The desired pairs of conductors are then twisted together, and the twisted pairs are bundled together as known in the art. Finally, the jacket is then provided on the bundle of conductors as known in the art.

In another embodiment of the invention, the color scheme can be provided by applying a non-insulating colored layer, including without limitation, a layer of paint, ink, or a UV coating, over the insulation layer. Alternatively, where no insulation is required, the non-insulating colored layer may be applied directly over the conductor or fiber.

The coloring scheme of the invention can also be used for twisted groups, rather than just pairs, of conductors. In this aspect of the invention, the coloring scheme can be used to identify 3 (or even more) conductors that are twisted together. Using this invention, the first conductor of this group could contain insulation with a dark color (i.e., dark blue), a second conductor could contain insulation with a lighter shade of the same color (i.e., medium blue), a third conductor could contain insulation with even a lighter shade of the same color (i.e., light blue). Of course, additional tints/shades of the color could be used where additional conductors are used in the group. The invention could also be used where groups of conductors that are not normally "twisted" still need to be classified as belonging together.

Figure 2:
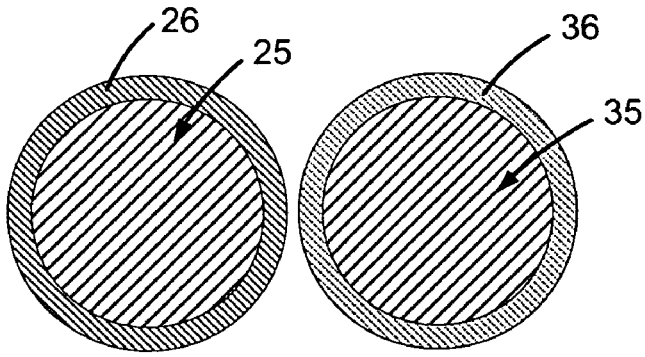
Figure 3:
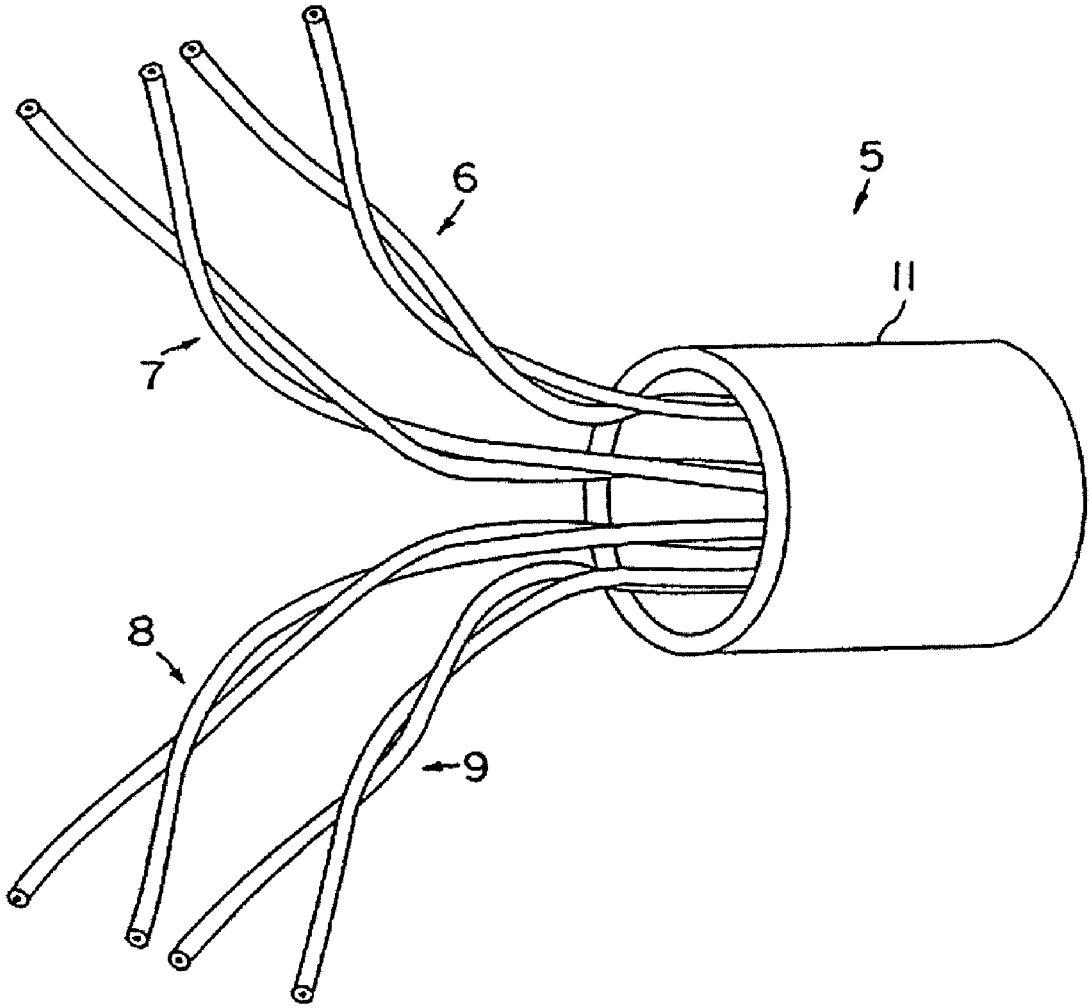

The coloring scheme of the invention is not limited to merely being used in metallic conductor cables, like those illustrated in FIGS. 1–3. The insulating materials of the invention can also be used in hybrid cables that include both optical fibers and metallic conductors. The coloring scheme can also be used communications apparatus not traditionally defined as a cable, such as wires and unjacketed pairs, or in communications apparatus that do not include conductors, such as fiber optic cables. In these configurations, the coloring scheme may be provided, for example, by applying an insulating material over the conductor or fiber, or by applying a non-insulating colored layer, such as paint or ink, directly over the conductor or fiber.

Figure 4:
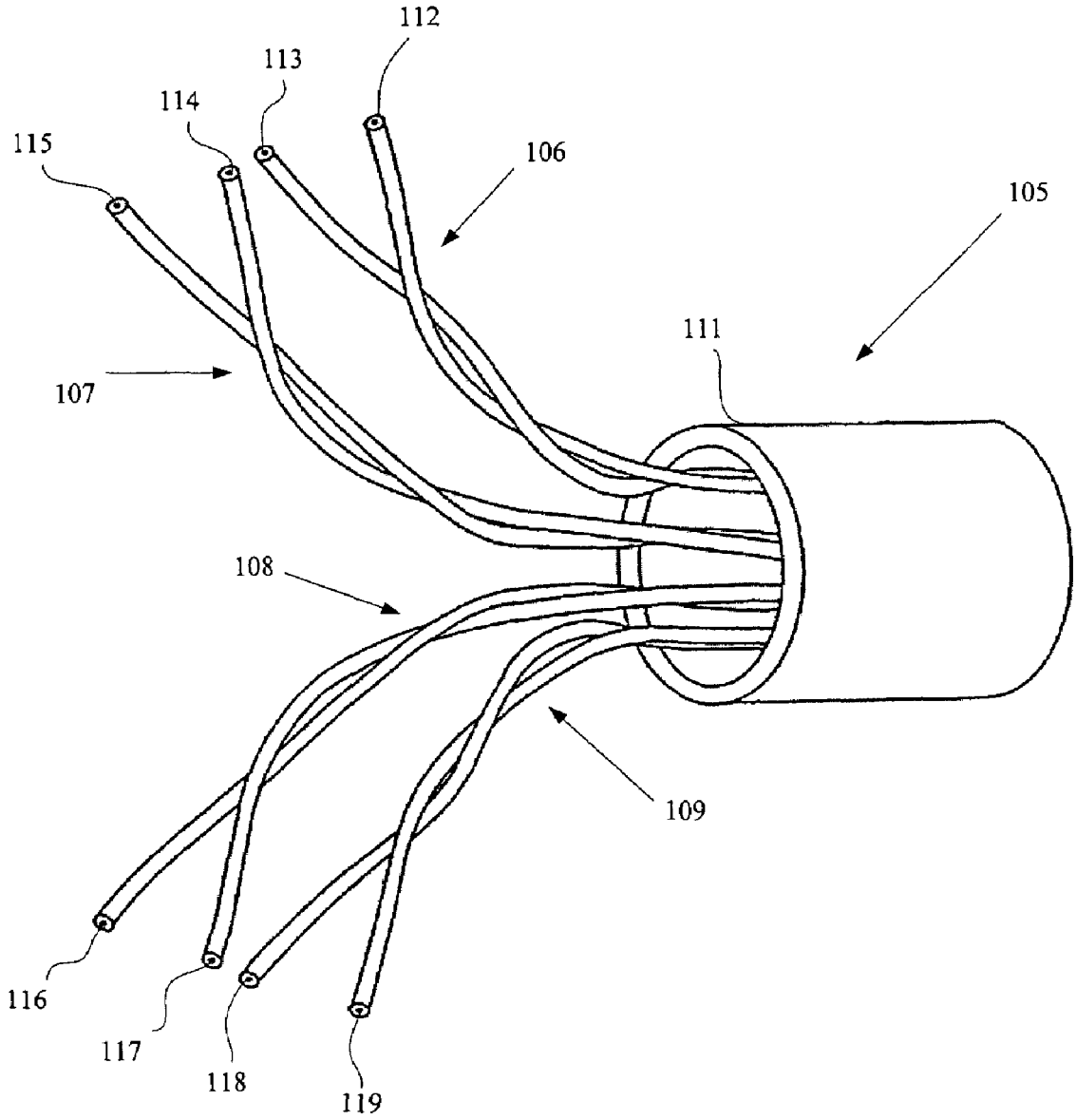

In another aspect of the invention, the coloring scheme can be used for a cable system containing groups of cables that are enclosed within a jacket. As illustrated in FIG. 4, the cable system 105 several groups 106, 107, 108, and 109 of cables 112, 113, 114, 115, 116, 117, 118, and 119 that are contained within an outer jacket 111. The cables can contain a single conductor or a plurality of conductors that are insulated and the cables can also have an outer insulation. It can be necessary to identify that cables within a specific group belong together, i.e., that cables 112 and 113 belong within group 106. The coloring scheme of the invention can be used for such identification by providing, for example, cable 112 with a solid color and cable 113 within the same group with various tints/shades of the same color.

Another aspect of the invention involves the use of a cable employing the color scheme described above with a connector having at least two terminals for connecting the cable to the connector. In an embodiment, a cable may be provided that includes at least two conductors or fibers, wherein a first conductor or fiber comprises a first color and a second conductor or fiber comprises a second color having a lighter tint of the first color. The connector includes at least two terminals—a first terminal being identified by the first color employed in the cable and a second terminal being identified by the second color employed in the cable.

Having described these aspects of the invention, it is understood that the invention defined by the appended claims is not to be limited by particular details set forth in the above description, as many apparent variations thereof are possible without departing from the spirit or scope thereof.

We claim:

1. A communications cable, comprising:

a tube longitudinally surrounding a hollow core and having a user accessible area; and a first group and a second group of conductors disposed in the hollow core, wherein the first group of conductors comprises:

a first conductor, circumscribed by a first shade of a first color selectively applied to the first conductor at the user accessible area; and a second conductor, circumscribed by a second shade of the first color selectively applied to the second conductor at the user accessible area, wherein the second group of conductors comprises:

a third conductor, circumscribed by a first shade of a second color selectively applied to the third conductor at the user accessible area; and a fourth conductor, circumscribed by a second shade of the second color selectively applied to the fourth conductor at the user accessible area.

2. The communications cable of claim 1, wherein the first and second conductors are a twisted pair.

3. The communications cable of claim 2, wherein the first and second shades of the first color are operable to identify the first and second conductors if they become untwisted.

4. The communications cable of claim 1, wherein the first group of conductors further comprises a fifth conductor, circumscribed by a third shade of the first color selectively applied at the user accessible area, and wherein the second group of conductors further comprises a sixth conductor, circumscribed by a third shade of the second color selectively applied at the user accessible area.

5. The communications cable of claim 1, wherein an inner and an outer layer of insulation circumscribes the first conductor and wherein the first shade of the first color is selectively incorporated into the outer layer.

6. The communications cable of claim 1, wherein the first shade of the first color is located in insulation of the first conductor.

7. The communications cable of claim 1, wherein a first numerical value specifies a level of the first color in the first shade of the first color, and wherein a second numerical value specifies another level of the first color in the second shade of the first color.

8. The communications cable of claim 7, wherein the first numerical value and the second numerical value are classifications on a numerical color scale, wherein the first shade of the first color and the second shade of the first color are only different enough to support visual color differentiation by a human installer of the communications cable, and wherein the communications cable further comprises a binder and a ripcord.

9. The communications cable of claim 1, wherein:

the first conductor is a first optical fiber with the first shade of the first color applied directly thereon;

the second conductor is a second optical fiber with the second shade of the first color applied directly thereon;

the third conductor is a third optical fiber with the first shade of the second color applied directly thereon; and the fourth conductor is a fourth optical fiber with the second shade of the second color applied directly thereon.

10. A communications cable, comprising:

a jacket defining a core and providing a location for user access; and at least two conductors within the core, wherein exclusively at the location, a first conductor is circumscribed by a first tint of a color directly adhering to the first conductor and a second conductor is circumscribed by a second tint of the color.

11. The cable of claim 10, wherein the first and second conductors are a twisted pair in the cable.

12. The cable of claim 10, wherein the difference between the first and second tints of the color can be distinguished by the naked eye.

13. The cable of claim 10, wherein the first tint of the color is located in an insulation for the first conductor, and wherein the second tint of the color is located in an insulation for the second conductor.

14. The cable of claim 13, wherein the insulation for the first conductor comprises an inner layer and an outer layer exclusively comprising the first tint of the color.

15. The cable of claim 10, wherein the first conductor comprises a first optical fiber, the second conductor comprises a second optical fiber, the first tint of the color is applied directly to a surface of the first optical fiber, and the second tint of the color is applied directly to a surface of the second optical fiber.

16. A communications system, comprising:

a first and second group of cables, wherein each group of cables contains at least two optical fibers, wherein a first optical fiber in the first group comprises a UV coating having a first tint of a color, and wherein a second optical fiber in the first group comprises a UV coating having a second tint of the color.

17. A communications system comprising:

a cable comprising a first and a second optical fiber, wherein the first optical fiber has a first color of ink applied directly thereto, and wherein the second optical fiber has a second color of ink, providing a lighter tint of the first color, applied directly thereto.

18. A method of making a cable, comprising:

providing a first insulated conductor and second insulated conductor;

identifying a location along the first insulated conductor and the second insulated conductor for user access;

at the identified location, selectively providing the first insulated conductor with a first color and a second insulated conductor with a second color having a lighter tint of the first color; and providing a jacket over the first and second conductor.

19. The method of claim 18, including providing the insulation for the first conductor with the first color and the insulation for the second conductor with the second color.

20. A method for making a cable system, comprising:

providing a first group of cables and a second group of cables, wherein each group of cables contains a plurality of cables;

providing, at a selected longitudinal location, a first cable in the first group with a first color and a second cable in the first group with a second color having a lighter tint of the first color; and providing a jacket over the first and second group of cables.

21. A method for identifying conductors within a cable, the method comprising the steps of:

determining an access location along the cable;

providing the cable with a first optical fiber and a second optical fiber; and at the access location, selectively covering the first optical fiber with a first color and the second optical fiber with a lighter tint of the first color.

* * * * *